US006691360B2

(12) United States Patent
Mukherjee et al.

(10) Patent No.: US 6,691,360 B2
(45) Date of Patent: Feb. 17, 2004

(54) IMPRESSION FOOTWEAR

(75) Inventors: Anup Mukherjee, Nashua, NH (US); Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 61 days.

(21) Appl. No.: 10/027,124

(22) Filed: Dec. 20, 2001

(65) Prior Publication Data

US 2003/0115691 A1 Jun. 26, 2003

(51) Int. Cl.[7] ..... A43B 3/12; A43B 3/10; A43B 9/02; A43B 13/28

(52) U.S. Cl. ..... 12/142 C; 12/142 RS; 12/146 BC; 36/11.5; 36/7.5; 36/21; 36/18

(58) Field of Search ..... 36/11.5, 7.5, 103, 36/117.3, 12, 18, 21, 22 R, 4, 25 R, 28, 30 R, 32 R; 12/146 BC, 146 BR, 146 C, 142 C, 142 E, 142 RS

(56) References Cited

U.S. PATENT DOCUMENTS 4,519,147 A * 5/1985 Jones, Jr. ..... 36/28
4,756,097 A * 7/1988 Sanders ..... 36/72 B
5,768,801 A * 6/1998 Huff ..... 36/28
5,784,736 A * 7/1998 Issler et al. ..... 12/142 B
5,896,677 A * 4/1999 Barsorian ..... 36/11.5
6,226,895 B1 * 5/2001 McClelland ..... 36/22 R
6,408,541 B1 * 6/2002 Moretti ..... 36/12
6,574,886 B1 * 6/2003 Issler ..... 36/12
2002/0020080 A1 * 2/2002 Duclos ..... 36/17 R
2003/0106170 A1 * 6/2003 Issler ..... 12/142 C

* cited by examiner

*Primary Examiner*—Anthony D. Stashick
(74) *Attorney, Agent, or Firm*—St. Onge Steward Johnston & Reens LLC

(57) ABSTRACT

A method for making footwear including forming an upper assembly; providing an outsole including a recessed region and a groove region formed around a periphery of the outsole; and attaching the upper assembly to the outsole. The upper assembly is formed by a fitted upper having a vamp to a socklining, the fitted upper then attached to a gasket. The present method provides the gasket which can readily receive a Opanka stitch series for joining the upper assembly and the outsole.

23 Claims, 9 Drawing Sheets

IMPRESSION FOOTWEAR

TECHNICAL FIELD

This invention relates to footwear and methods of constructing footwear.

BACKGROUND

A variety of constructions for making footwear are used by the footwear industry. For the most part, each footwear construction has characteristics that make it particularly well suited for durability, comfort, and ease of production. Typically, in an effort to improve efficient manufacturing and the aesthetic appeal of the footwear, a number of different assembly methods can be used.

SUMMARY

In a general aspect of the invention, a method for constructing footwear includes forming an upper assembly, providing an outsole including a recessed region and a groove region formed around a periphery of the outsole, and attaching the upper assembly to the outsole. Forming the upper assembly includes providing a gasket, a fitted upper including a vamp attached to a socklining, and attaching the fitted upper to the gasket.

In embodiments of the invention, one or more of the following features may also be included. The method also includes close-seaming the gasket around a perimeter of the socklining.

In certain embodiments, the method includes providing a groove molded around an outsole peripheral region, and pushing a lower edge of an Opanka stitched gasket into the groove.

As yet another feature, the method includes covering the outsole with a wrapper, the wrapper covering an outsole heel region and an outsole front region.

Further, the method comprises adhesively attaching a cushioning layer within the recessed region of the outsole.

As another feature, the method includes sewing the upper assembly to the outsole by using an Opanka stitch series as well as stitching the gasket using the Opanka stitch series to an outsole perimeter rim, thus forming a double seam Opanka stitch series. The sewing can be hand-made.

Moreover, the method includes pushing an upper edge of the wrapper into the groove, joining a lower edge of the Opanka stitched impression gasket.

According to another aspect of the invention, a footwear includes an upper assembly and an outsole including a recessed region and a groove region formed around a periphery of the outsole. The outsole is attached to the upper assembly. The upper assembly includes a gasket and a fitted upper including a vamp attached to a socklining, and the fitted upper attached to the gasket.

In embodiments of the invention, one or more of the following features may also be included. The gasket is close-seamed around a perimeter of the socklining, and a groove molded is provided around an outsole peripheral region. A lower edge of an Opanka stitched gasket is inserted into the groove.

In certain embodiments, the outsole is covered with a wrapper. The wrapper can cover an outsole heel region and an outsole front region.

As another feature, a cushioning layer is adhesively attached within the recessed region of the outsole.

As yet another feature, a heel is provided in the outsole. Moreover, the upper assembly of the footwear is sewed to the outsole by using Opanka stitch series and the impression gasket is stitched to an outsole perimeter using the Opanka stitch series.

In addition, an upper edge of the wrapper is inserted into the groove joining a lower edge of the Opanka stitched impression gasket.

As another feature, the upper assembly of the footwear is made of leather and the outsole is made of polyurethane. The gasket can be made of the same material as the upper assembly. As another feature, a walking surface layer having a notch line across in an outsole peripheral region is provided with the notch line accommodating the wrapper around an outsole heel region and an outsole front region.

Embodiments may have one or more of the following advantages.

Among other advantages of making footwear using the above described method is that an outsole is configured to readily receive a completed upper assembly. Thus, the upper assembly can be simply and economically attached to the outsole. Another advantage of this method lies in providing a styled, durable, and lightweight footwear. Given a practical outsole to which an upper assembly can be readily attached and stitched to form an Opanka stitch series, the process efficiently streamlines footwear production and manufacturing.

Another advantage is that the process of attaching the upper assembly to the outsole provides durability and resistance to all the components of the footwear. Even with prolonged daily wear on abrasive walking surfaces, the outsole is less prone to deformation due to the flexibility, resilience, solid design, and strength of the outsole.

In addition, this method of making footwear inherently enhances the overall appearance of the footwear by permitting genuine hand-sewn seams in the form of double-seam Opanka stitch series provided around the entire periphery of the shoe. A fashionable style results not only from the various durable components but also from the superior look of their combined assembly. Another advantage of this footwear is the enhanced comfort provided by the cushioning layer of the outsole and the flexible design of the outsole, which significantly reduces foot and leg muscle fatigue.

Moreover, the pre-engineered apertures in the impression gasket provided for forming the hand-sewn seams ensure accuracy of seaming and wrapping locations as required for improved fitting qualities.

Furthermore, the footwear has a smoother, finished interior without requiring a platform. Accordingly, a wearer's foot rests on the socklining which rests on the cushioning layer, thereby creating optimum comfort conditions.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
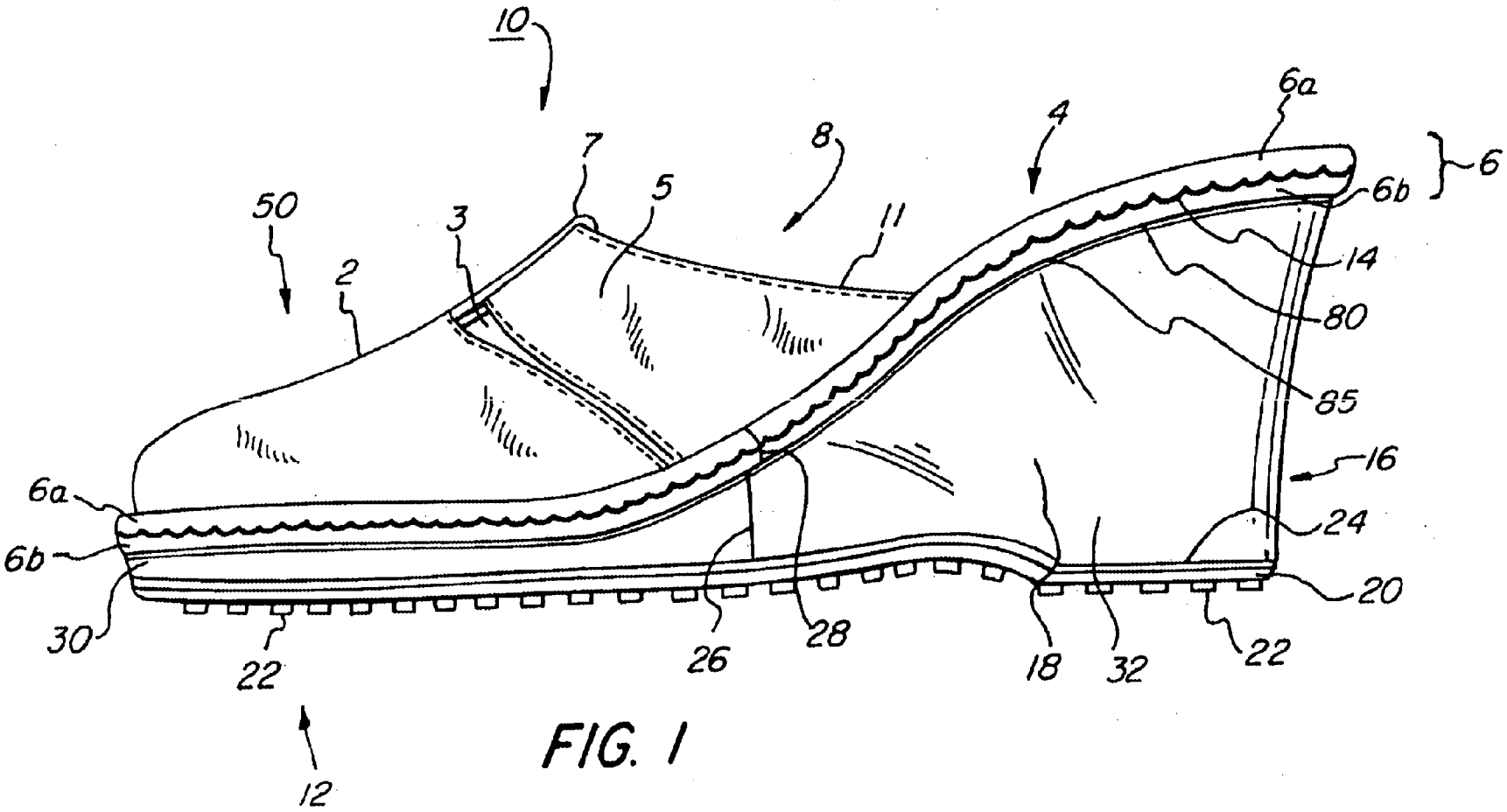
FIG. 1 is a schematic side view of a footwear.

Referring now to the figures in which identical elements are numbered identically throughout, a description of the embodiments of the present invention will now be provided.

A dress-type sandal footwear 10 is described with respect to FIGS. 1–7. Footwear 10 is constructed by joining an upper assembly 50 to an outsole 12. The upper assembly 50 includes a fitted upper 15 formed by a vamp 2 attached to a socklining 4, preferably by machine-sewing, forming an internal spacing 8 where a wearer's foot is inserted. The upper assembly 50 further includes an impression gasket 6 that is combined with the fitted upper 15 and the socklining 4.

Referring to FIG. 1, the vamp 2 covers the upper region of a wearer's foot and toes. The vamp 2 can have various types of designs and constructions (e.g., close-toe design or open-toe design). The vamp 2 can also include ornamental features. In this embodiment, the vamp 2 includes a vamp strap 5 that is held by a strap holder 7. The vamp strap 5 includes a perimeter border stitching 11 to prevent loose threads and give the footwear 10 a styled clean appearance. Aesthetic decoration is provided so that the footwear 10 can have a distinctive appeal. In addition, vamp slits 3 are formed which not only provide a stylish and attractive quality but also help ventilate the wearer's foot especially when the wearer is barefoot. The vamp 2, in this embodiment, incorporates a toe box design so that the internal spacing 8 especially in the toe region (not shown) provides roomier spacing for accommodating the wearer's toes. This way, the wearer can prevent various toe ailments and also easily place or remove the footwear 10 from her feet. Moreover, the vamp 2 may also include an inner liner 9 to cover an interior wall of the vamp 2 for aesthetic as well as practical purposes such as absorbing moisture when the footwear 10 is again worn barefoot. Thus, in general, the shape and design of the vamp 2 increases comfort by providing a roomier and more relaxed fit.

Figure 2:
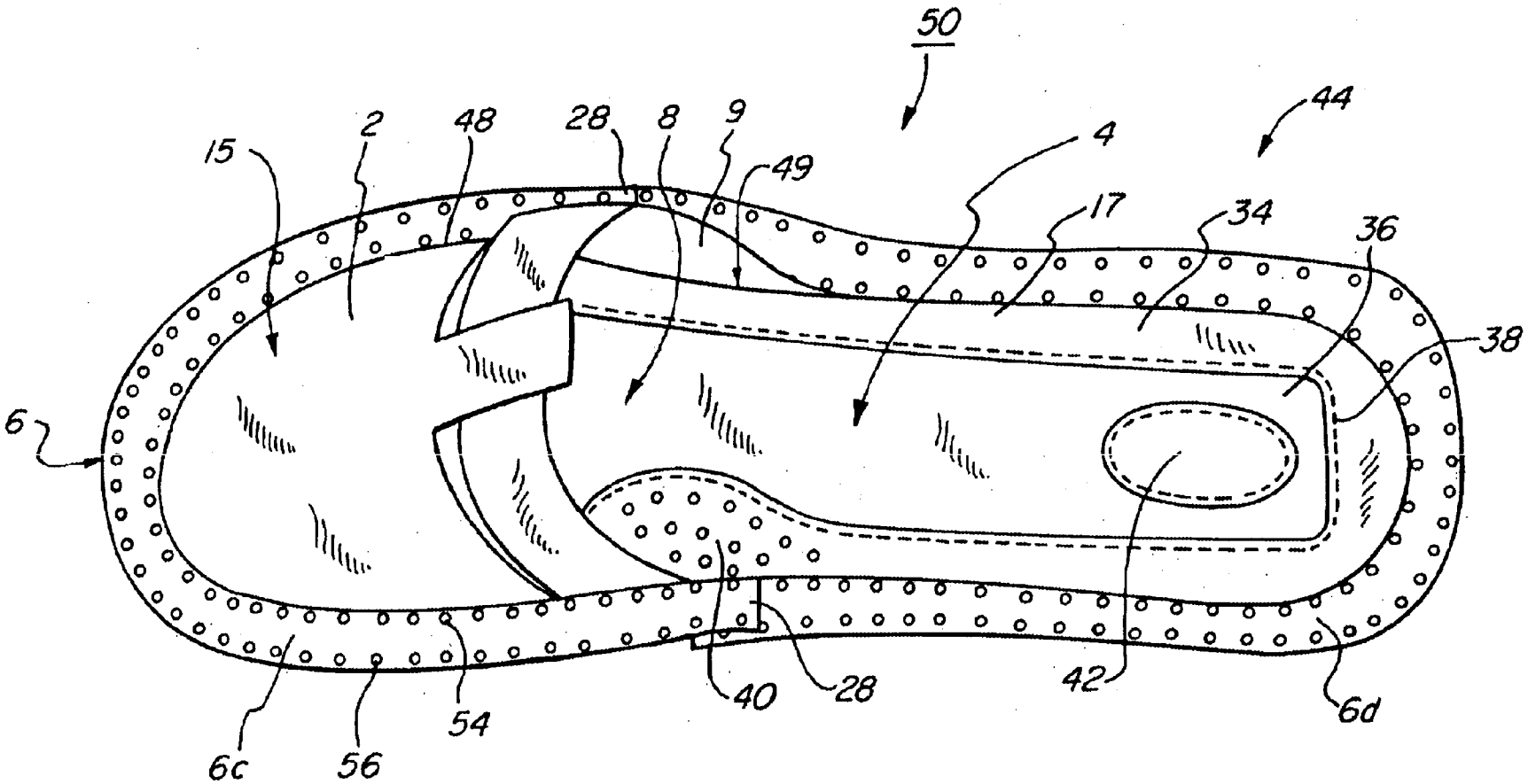
FIG. 2 is a top view of an upper assembly.

Referring to FIG. 2 in particular, the upper surface 44 of the socklining 4 is shown stitched to the impression gasket 6. The vamp 2 is shown attached to the socklining 4 by a close-seam 48, i.e., forming a line of junction by sewing together two pieces of material along their margins and hiding the stitching by reversing, along the socklining perimeter 17 extending the region corresponding to the internal spacing 8 of the footwear 10. In this embodiment, the socklining 4 includes a padding to provide cushioning and support to the wearer's foot. The socklining 4 is made up of two components: a socklining skeleton 34 and a socklining base 36. The socklining base 36 includes a larger surface area than the socklining skeleton 34. The socklining skeleton 34 is superimposed on the socklining base 36 and then machine sewed, thereby forming a socklining seam 38. The socklining skeleton 34 includes an arch support 40. The arch support 40 as well as the socklining skeleton 34 have air apertures 25 to increase the porosity of the already porous socklining 4 for foot ventilation, drying, and comfort. The socklining 4 includes an ornamental label 42 for brand recognition. The socklining 4 is made of any suitable material. In some embodiments, the socklining 4 is decoratively quilted to provide an aesthetically pleasing look to the interior surface of the footwear 10.

Still referring to FIG. 2, once the socklining 4 is joined to the vamp 2, a fitted upper 15 is formed. The fitted upper 15 is attached to the impression gasket 6 along the socklining perimeter 17 by a close-seam operation. In this embodiment, the impression gasket 6 is formed by two "U-shaped" parts, a first part 6*c* covers a front portion of the impression gasket 6 and a second part 6*d* covers a rear portion of the impression gasket 6. Both parts 6*c* and 6*d* include perforation for the Opanka stitching, as described further below. The impression gasket 6 includes a series of interior perforation 54 and a corresponding series of perimeter perforation 56 preformed in the impression gasket 6 in preparation for the Opanka stitch 14. Further, the impression gasket 6 includes overlap ends 28 formed by an assembly-line production of this component at the manufacturing level.

Figure 3:
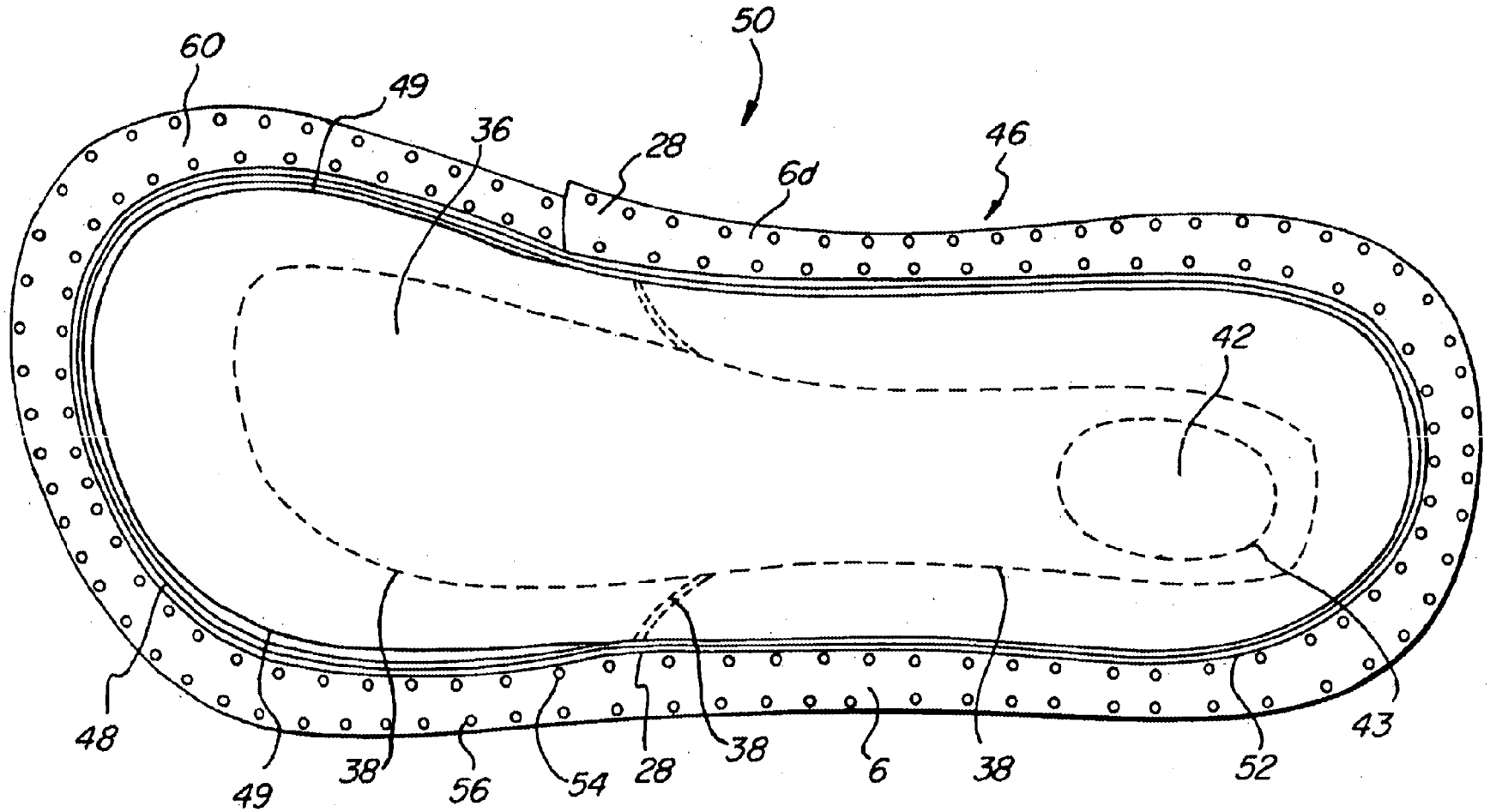
FIG. 3 is a bottom view of the upper assembly of FIG. 2.

Referring to FIG. 3, an under surface 46 of the socklining 4 having the impression gasket 6 attached to the socklining 4 is illustrated. Various components of the upper assembly 50 are joined by the closed seam 48 and a vamp seam 49. In particular, the socklining base 36 and the socklining skeleton 34 (FIG. 2) are close seamed with the fitted upper 15, and the first part 6*c* and second part 6*d* of the impression gasket 6 are close seamed thus forming the close seam 48. The impression gasket 6 is also joined to the socklining base 36 in the close seam 48. Although this embodiment only uses one close seam 48, other embodiments may include more than one stitch series, preferably provided by a machine stitching operation, for attaching the various components of the fitted upper 15. In addition, the vamp seam 49 joins the vamp 2 to the socklining 4, and the socklining seam 38 joins the socklining base 36 to the socklining skeleton 34. FIG. 3 also shows the ornamental label 42 stitched with a seam 43 to the socklining base 34.

The outsole 12 of the footwear 10 will now be described. Returning to FIG. 1, the outsole 12 is illustrated including a heel 16, a wrapper 18, a walking surface layer 20, and non-skid bumps 22. The outsole 12 is described in more detail with respect to FIG. 4 below.

Figure 4:
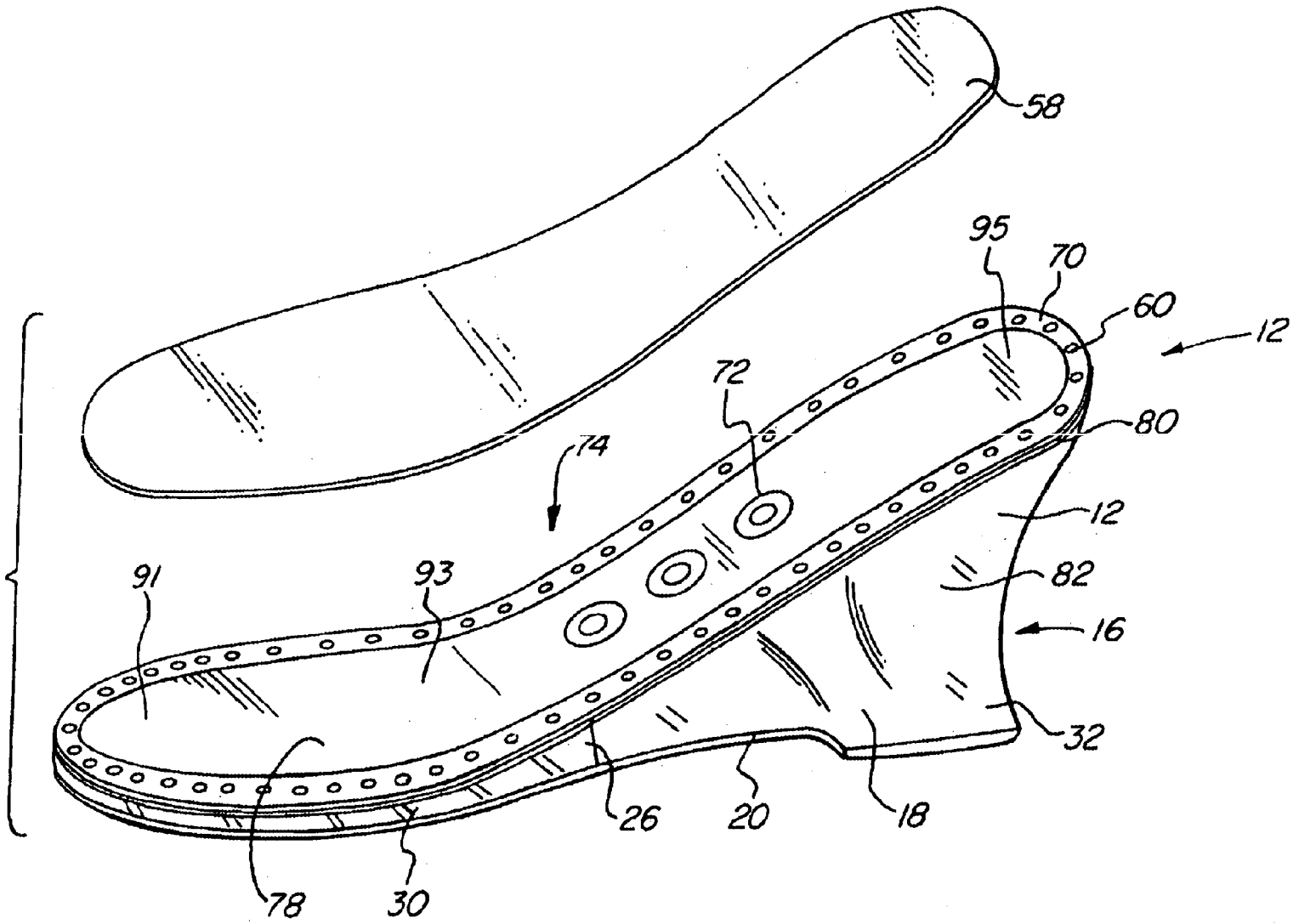
FIG. 4 is a perspective view of an outsole and cushioning layer.

Referring to FIG. 4, the outsole 12 includes an upper surface 74, having a recessed region 78 bordered by an outsole perimeter rim 70. The recessed region 78 includes outsole cavities 72 for reducing the weight of the outsole 12 and providing added elasticity to the completed footwear 10. The outsole perimeter rim 70 includes outsole stitching holes 60 along the entire area of the outsole perimeter rim 70.

The recessed region 78 accommodates a cushioning layer 58, preferably made of foam material such as polyurethane. The cushioning layer 58 is positioned over the entire area of the recessed region 78. The softness and shock-absorbent qualities of the polyurethane can be varied from application to application by using a variety of well-known techniques, such as adjusting the type and proportionate amount of reactants. In addition, the softness and shock-absorbent qualities of the foam can be varied by adjusting the volume of foam deposited in the recessed region 78.

The cushioning layer 58 includes reduced edges and is preferably about 3–5 mm in thickness. The cushioning layer 58 provides shock-absorption and gives the support needed to provide soft cushioning and long term comfort. The cushioning layer 58 is bound tightly to the recessed region 78 and the under surface 46 of the socklining 4 using an adhesive and is further held securely in place by the Opanka stitch series 14. Preferably, the cushioning layer 58 is shaped in conformity with the recessed region 78 and spaced about ¼ inch from the outsole perimeter rim 70 of the outsole 12.

The outsole 12 provides a flexible and durable structure for the footwear 10. Accordingly, for its construction, the outsole 12 is preferably made of polyurethane although it may be produced using any suitable material having similar characteristics. Lightweight plastic materials may be used. The outsole 12 is also preferably designed to provide a styled silhouette making the footwear 10 aesthetically desirable as well as extremely comfortable.

The outsole 12 includes the heel 16 covered by a wrapper 18. The characteristics of the heel 16 are best described with respect to FIG. 5 where the outsole 12 includes, in large part, an outsole heel region 82.

Figure 5:
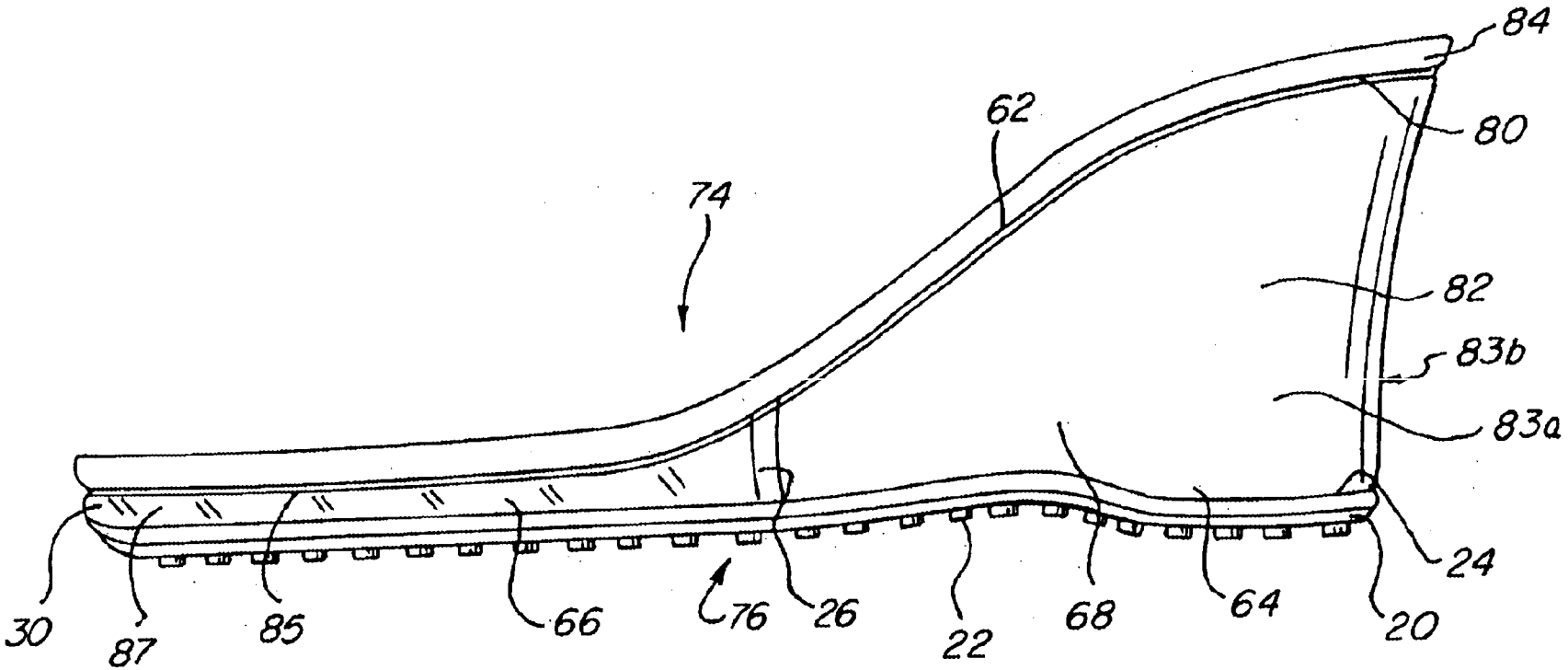
FIG. 5 is a schematic side view of the outsole of FIG. 4.

Referring now to FIG. 5, a side view of the outsole 12 is shown with only an outsole front region 87 covered with the wrapper 18 (area 66) and with the remaining outsole heel region 82 (area 68) not covered by the wrapper 18, for illustration purposes only. Outsole perimeter rim 70 of FIG. 4 becomes the outsole upper side strip 84. A groove 80 is formed between the outsole upper side strip 84 and the outsole heel region 82. The groove 80 is molded around an outsole upper peripheral region 62 and extends along the entire peripheral region 62.

The outsole heel region 82 includes outsole side heel areas 83*a* and 83*b,* shaping the heel 16 like a wedge, thicker at the heel end and tapered to a thin edge at the front end of the footwear 10, i.e., the front region 87.

In the area 68 where the outsole 12 is not covered by the wrapper 18, the groove 80 is shown as illustrated in FIG. 4, which is used in the operation that forms the double seam Opanka stitch 14.

In contrast, when the outsole 12 is covered by the wrapper 18, a forward region 30 and a rearward region 32 of the wrapper 18 covers the outsole front region 87 and the side heel areas 83*a* and 83*b,* respectively. When the wrapper 18 covers the outsole 12, the notch line 24 serves to guide the placement of the wrapper 18 around the outsole 12, beginning and finishing this wrapping process at the overlap ends 26. The notch line 24 is positioned in a lower peripheral region 64 immediately above the walking surface layer 20. The walking surface layer 20 has a downward tapered configuration ending at an under surface 76. The under surface 76 includes non-skid bumps 22 that provide traction against slippery walking floors or surfaces.

Referring back to FIGS. 1 and 4, the wrapper 18 and the impression gasket 6 join at the groove 80 provided the wrapper 18 covers the outsole 12. In particular, a lower edge 6*b* of the Opanka-stitched impression gasket 6 is tucked within or inserted into the groove 80. As the wrapper 18 covers the outsole 12, the lower edge 6*b* is joined by an upper edge 85 of the wrapper 18 which runs along the upper peripheral region 62 of the outsole 12. In other words, the upper edge 85 of the wrapper 18 is inserted into the groove 80 thereby meeting with the lower edge 6*b* of the impression gasket 6. This 'tucking' operation which produces a high quality dress-type shoe like the footwear 10 will be further described below in connection with a description of its construction process.

Furthermore, in this embodiment, the wrap 18 that covers the outsole 12 and the upper assembly 50 are made of the same material (e.g., leather). This way, footwear 10 has a coherent, pleasing look. The footwear 10 can be made from several different types of leather. An inner lining 9 (shown in FIG. 2) may also be made of a thinner, more absorbent, and breathable type of leather, or polyester. Although leather is preferably the material of choice for quality dress type sandals like the footwear 10, a suitable material with good qualities, i.e., light-weight, tear resistant, durable, and stylish, can be used. For example, high quality stitched-in textile made of strong fiber material, can be used for the construction of the upper assembly 50 and the wrap 18.

Figure 6:
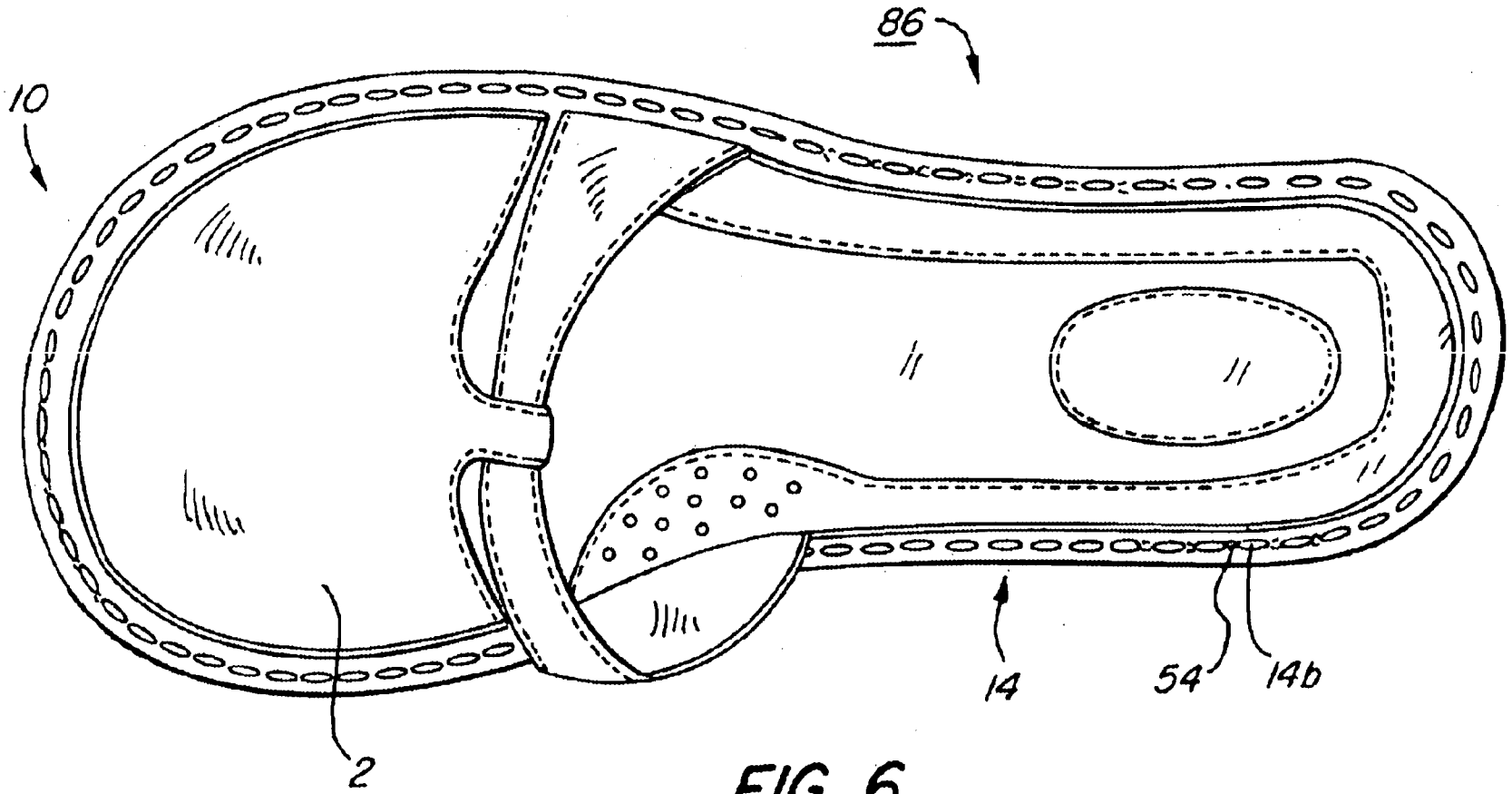
FIG. 6 is a top view of the footwear of FIG. 1.

The double seam operation will now be described with respect to FIG. 6 which shows an upper surface 86 of the footwear 10. The upper Opanka stitch series 14*a* attach the impression gasket 6 to the outsole 12, namely, the outsole perimeter rim 70, through the interior perforation 54 of the gasket 6. The upper Opanka stitch series 14*a* is best illustrated in the schematic side view of the footwear 10 provided in FIG. 1. In a complementary manner, the upper Opanka stitch series 14*a* is accompanied by a side Opanka stitch series 14*b,* thus creating the 'double seam' sophisticated styled look characteristic of this embodiment.

Figure 7:
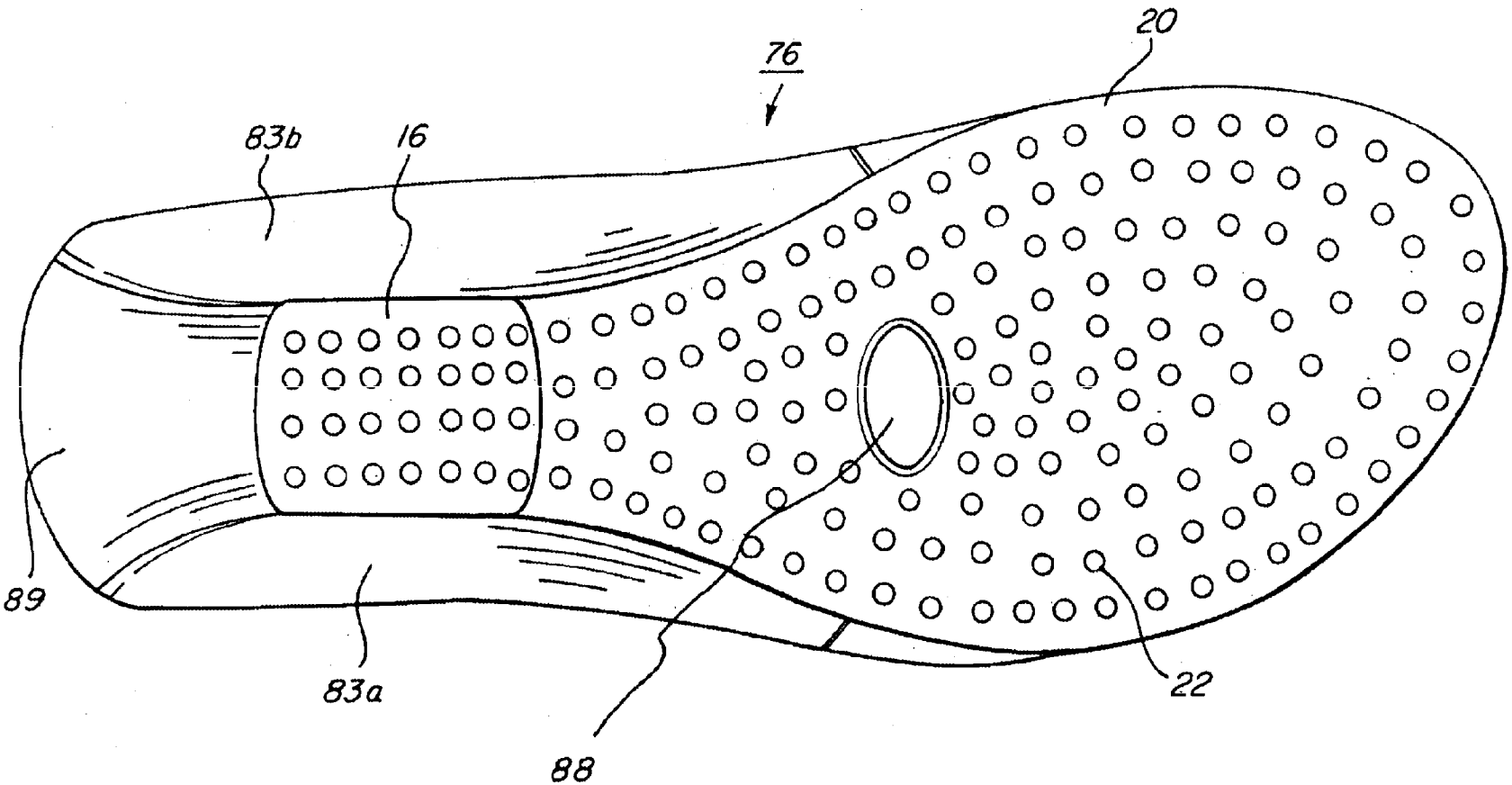
FIG. 7 is a bottom view of the footwear of FIG. 1.

Referring to FIG. 7, an under surface 76 of the footwear 10 is illustrated. The under surface 76 shows the tapered, curved configuration of the heel 16. The outsole side heel areas 83*a* and 83*b* are clearly shown in relation to a heel back edge 89. The under surface 76 includes, most importantly, the walking surface layer 20 having non-skid bumps 22 in a pattern of small circular dots. Such a pattern has both practical and aesthetic considerations. The walking surface layer 20 is preferably made of molded polyurethane and ensures that the contact between the ground and the walking surface is uniformly distributed so that the footwear 10 can be worn for prolonged periods. Moreover, the non-skid bumps 22 provide heel support, lift, and protection from slippery surfaces providing improved traction and safety. In addition, the heel back edge 89 and the outsole side heel areas 83*a* and 83*b* are designed to create the appearance of a highly styled heel 16.

The construction method for this embodiment will now be described in conjunction with the accompanying figures.

In preparation for constructing the footwear 10, the vamp 2 is cut, stitched, and finished. Ornamental details are provided in the vamp 2 if desired.

The components of the socklining 4 are also assembled, cut, and stitched. In particular, the socklining skeleton 34 is stitched to the socklining base 36 forming the socklining seam 38. If desired, the ornamental label 42 is now affixed to the socklining base 36 in the upper surface 44. Then, the vamp seam 49 joins the vamp 2 to the socklining 4. The attachment of the socklining 4 to the vamp 2 can be performed as in a California construction thereby providing the fitted upper 15.

Next, the impression gasket 6 is stitched to the socklining 4 to form the close seam 48 along the entire socklining perimeter 17, preferably by a sewing operation. During this process, care is taken to ensure that the overlap ends 28 of the impression gasket effectively cover the entire socklining perimeter 17. This way, the impression gasket 6 is close-seamed following the curves around the socklining perimeter 4, which will accurately conform to the shape of the outsole upper peripheral region 62, and specifically, the outsole perimeter rim 70. This completes the manufacture of the upper assembly 50.

At this point of the process, the outsole 12 is ready to be attached to the upper assembly 50. The outsole 12 is molded using an appropriate polyurethane mold to form the recessed region 78; the outsole perimeter rim 70 which includes the outsole holes 60 for the Opanka stitch series; the groove 80; the notch line 24; the walking surface layer 20; and the non-skid bumps 22. Prior to attaching the outsole 12 to the upper assembly 50, the cushioning layer 58 is adhesively attached to the under surface 46 of the socklining 4 as well as to the recessed region 78 of the outsole 12.

Thereafter, the interior perforation 54 and the perimeter perforation 56 of the impression gasket 6 in conjunction with the outsole holes 60 form the double seam Opanka stitch series 14. Consequently, the Opanka stitch series 14 join the upper assembly 50 to the outsole 12. The resulting double seam operation is described in greater detail below.

The impression gasket 6 is aligned above the outsole perimeter rim 70 so that the interior perforation 54 are aligned above the series of outsole holes 60. In particular, the double seam 14 is formed by creating an upper Opanka stitch series 14*a* by passing a suitable and durable thread through the interior perforation 54 and the outsole holes 60 and also creating a side Opanka stitch series 14*b* by passing preferably the same thread through the perimeter perforation 56. This double seam 14 operation generates a rounded edge 6*a* and the lower edge 6*b* of the impression gasket 6 as shown in FIG. 1. Moreover, the rounded edge 6*a* forms the upper side strip 84 as illustrated in FIG. 5.

Subsequently, the lower edge 6*b* is tucked inside the groove 80 forming a neatly packed upper assembly 50 joined to the outsole 12.

In this embodiment, the wrapper 18 is provided to cover the outsole 12, in particular, the outsole heel region 82, i.e., the outsole side heel areas 83*a* and 83*b*, the outsole front region 87, and the heel back edge 89. The forward region 30 of the wrapper 18 is cut to accurately fit the thinner width shape of the outsole front region 87 and similarly the rearward region 32 of the wrapper 18 is cut to fit the shape of the outsole heel region 82. As the wrapper 18 is prepared to cover the outsole 12, the notch line 24 guides the close-fit placement of the wrapper 18, specifically, in the outsole lower peripheral region 64. The wrapper 18 is aligned with and wrapped around the outsole 12, from one of the overlapping ends 26 to another, both of which are then glued together when they meet so that no loose pieces of the overlap ends 26 will be formed. The notch line 24 allows the wrapper 18 to present a smooth and stylish look for the entire footwear 10 by providing a structural separation layer between the walking surface layer 20 and the outsole 12 which is covered by the wrapper 18.

Finally, in this embodiment, as the wrapper 18 covers the outsole 12, the upper edge 85 of the wrapper 18 which runs around the upper peripheral region 62 of the outsole 12 is tucked in or inserted into the groove 80. That is, the upper edge 85 of the wrapper 18 joins the lower edge 6*b* of the impression gasket 6 inside the groove 80. Accordingly, the groove 80 securely holds the upper edge 85 of the wrapper and the lower edge 6*b* of the impression gasket 6 folded in. The result is a 'tight', well-formed design without any unsecured or loose parts. Although the wrapper 18 is provided in this particular embodiment, outsole 12 can be used without any covers such as the wrapper 18. The completed footwear is shown in FIG. 1.

Figure 8:
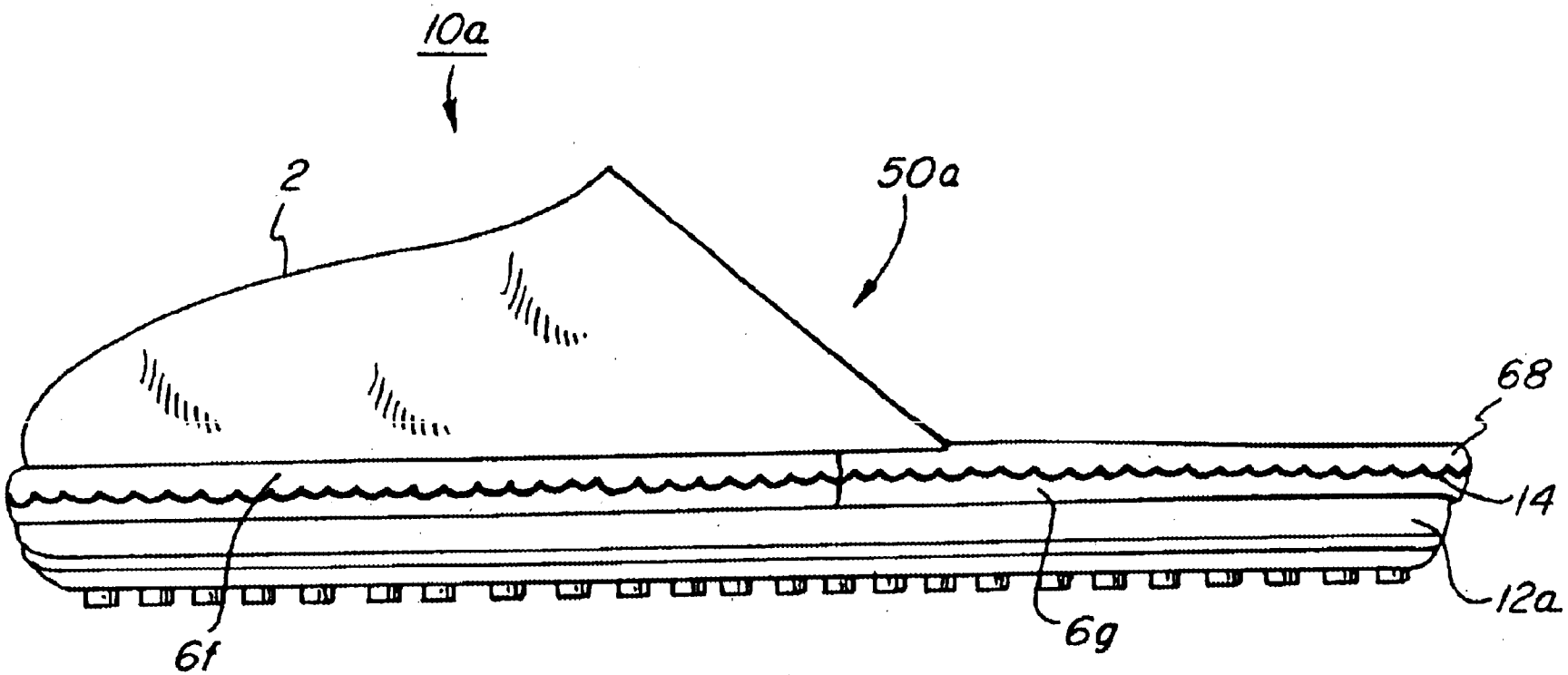
FIG. 8 shows a second embodiment of the footwear of FIG. 1.
Figure 9:
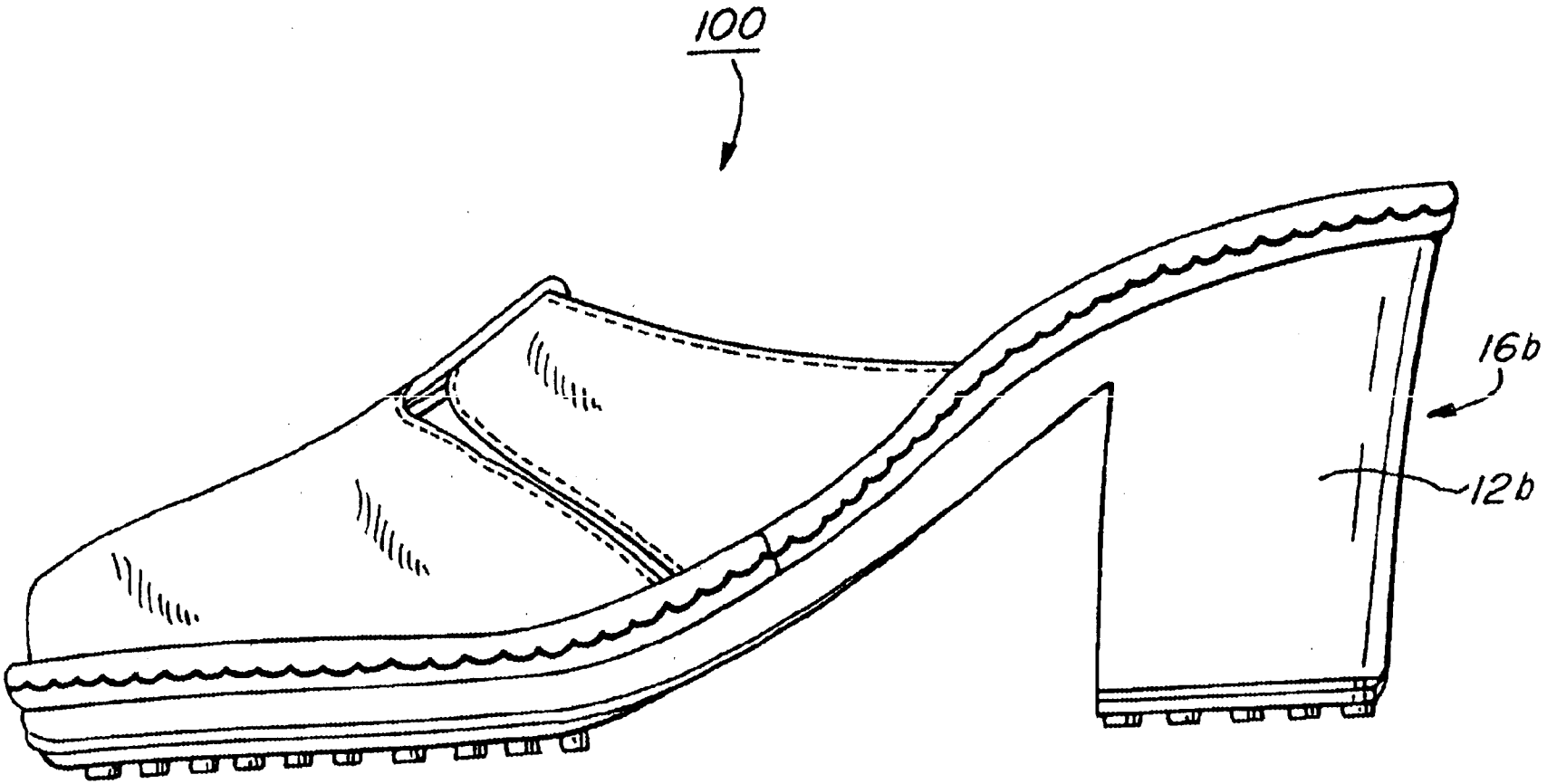
FIG. 9 shows a third embodiment of the footwear of FIG. 1.

In another embodiment as shown in FIG. 8, a footwear 10*a* is provided having a flat outsole 12*a* attached to an upper assembly 50*a* by an Opanka stitch series 14. An impression gasket 6*e* is provided extending the length of the footwear 10*a*. The impression gasket 6*e* includes two "U-shaped" parts. A first part 6*f* covers a front portion of the impression gasket 6 and a second part 6*g* covers a rear portion of the impression gasket 6. Both parts 6*f* and 6*g* include perforation for the Opanka stitching. In another embodiment as shown in FIG. 9, a heel 16*b* is in the form of an open heel type with an outsole 12*b* shaped accordingly.

Although the invention, preferably relates to casual sandals, other fields of application are entirely within the scope of the invention, especially in the broad sector of footwear manufacturing. Thus, a number of embodiments of the invention have been described. Nevertheless, it will be understood that various modifications may be made without departing from the spirit and scope of the invention. Accordingly, other embodiments are within the scope of the following claims.

What is claimed is:

1. A method for construction of footwear comprising:

forming an upper assembly including:

providing a gasket;

providing a fitted upper including a vamp attached to a socklining;

attaching the fitted upper to the gasket;

providing an outsole including a recessed region and a groove region formed around a periphery of the outsole;

attaching the upper assembly to the outsole;

close-seaming the gasket around a perimeter of the socklining and providing a groove molded around an outsole peripheral region; and pushing a lower edge of an Opanka stitched gasket into the groove and covering the outsole with a wrapper.

2. The method of claim 1 further comprising stitching the vamp to the socklining by machine stitching and sewing the upper assembly to the outsole by using Opanka stitch series.

3. The method of claim 1 further comprising adhesively attaching a cushioning layer within the recessed region of the out sole.

4. The method of claim 1 further comprising providing a heel in the outsole.

5. The method of claim 1 further comprising stitching the impression gasket using Opanka stitch series to an outsole perimeter rim.

6. The method of claim 1 wherein the wrapper covers an outsole heel region.

7. The method of claim 6 further comprising pushing an upper edge of the wrapper into the groove, joining a lower edge of the Opanka stitched impression gasket.

8. The method of claim 1 further comprising sewing the upper assembly to the outsole by using Opanka stitch series to form a double seam Opanka stitch series.

9. The method of claim 8 wherein the sewing is handmade.

10. The method of claim 1 wherein the gasket is made of the same material as the upper assembly, the outsole is made of polyurethane.

11. The method of claim 1 further providing a walking surface layer having a notch line across in an outsole peripheral region, the notch line accommodating the wrapper around an outsole heel region and an outsole front region.

12. The method of claim 1 further comprising prepunching the outsole for sewing.

13. A footwear comprising:

an upper assembly including:

a gasket; and, a fitted upper including a vamp is attached to a socklining, wherein the fitted upper is attached to the gasket;

an outsole including a recessed region and a groove region formed around a periphery of the outsole, the outsole attached to the upper assembly; and wherein a lower edge of an Opanka stitched gasket is inserted into the groove and the outsole is covered with a wrapper.

14. The footwear of claim 13 wherein the gasket is close-seamed around a perimeter of the socklining and a groove molded is provided around an outsole peripheral region.

15. The footwear of claim 13 wherein a cushioning layer is adhesively attached within the recessed region of the outsole.

16. The footwear of claim 13 wherein the upper assembly is sewed to the outsole by using Opanka stitch series.

17. The footwear of claim 13 wherein a heel is provided in the outsole.

18. The footwear of claim 13 wherein the impression gasket using Opanka stitch series is stitched to an outsole perimeter rim.

19. The footwear of claim 13 wherein a wrapper covers an outsole heel region.

20. The footwear of claim 19 an upper edge of the wrapper is inserted into the groove joining a lower edge of the Opanka stitched impression gasket.

21. The method of claim 13 wherein the upper assembly is hand sewed to the outsole by using Opanka stitch series wherein the upper assembly to the outsole forms a double seam Opanka stitch series, the double seam including an upper Opanka stitch series and a side Opanka stitch series.

22. The method of claim 19 wherein a walking surface layer having a notch line across in an outsole peripheral region is provided, the notch line accommodating the wrapper around an outsole heel region and an outsole front region.

23. The method of claim 13 wherein the outsole is pre-punched for sewing.

* * * * *